US007793482B2

(12) United States Patent
Becker et al.

(10) Patent No.: US 7,793,482 B2
(45) Date of Patent: Sep. 14, 2010

(54) WALL FASTENER

(76) Inventors: Brian Becker, 9 Cherry Cir., St. Cloud, MN (US) 56304; Derek Becker, 34747 CSAH 17, Watkins, MN (US) 55380; Robin Dockery, 17315 County Rd. 48, Kimball, MN (US) 55353

( * ) Notice: Subject to any disclaimer, the term of this patent is extended or adjusted under 35 U.S.C. 154(b) by 0 days.

(21) Appl. No.: 11/875,786

(22) Filed: Oct. 19, 2007

(65) Prior Publication Data

US 2008/0078140 A1 Apr. 3, 2008

Related U.S. Application Data

(62) Division of application No. 10/750,998, filed on Dec. 30, 2003, now Pat. No. 7,284,355.

(51) Int. Cl.
*E04B 1/38* (2006.01)

(52) U.S. Cl. ..... 52/712; 52/290; 52/489.1

(58) Field of Classification Search ..... 52/290, 52/241, 242, 489.1, 300, 220.7, 712
See application file for complete search history.

(56) References Cited

U.S. PATENT DOCUMENTS

| | | | | |
|---|---|---|---|---|
| 1,801,240 | A * | 4/1931 | Schaffert | 52/489.1 |
| 3,232,018 | A | 2/1966 | MacKean | |
| 3,233,857 | A | 2/1966 | Schuck | |
| 3,685,227 | A | 8/1972 | Grisard et al. | |
| 4,798,035 | A | 1/1989 | Mitchell et al. | |
| 5,009,051 | A | 4/1991 | Trezza | |
| 5,471,805 | A | 12/1995 | Becker | |
| 5,755,066 | A | 5/1998 | Becker | |
| 6,625,941 | B2 | 9/2003 | Shaw | |
| 6,640,516 | B1 | 11/2003 | Thompson | |
| 6,647,691 | B2 | 11/2003 | Becker et al. | |
| 6,792,733 | B2 * | 9/2004 | Wheeler et al. | 52/656.1 |
| 7,021,021 | B2 * | 4/2006 | Saldana | 52/696 |
| 7,284,355 | B2 | 10/2007 | Becker et al. | |
| 2002/0170260 | A1 * | 11/2002 | Wheeler et al. | 52/656.1 |
| 2003/0126820 | A1 * | 7/2003 | Callahan et al. | 52/514 |

FOREIGN PATENT DOCUMENTS

| | | |
|---|---|---|
| WO | WO-2005065295 | 7/2005 |

OTHER PUBLICATIONS

Non-Final Office Action mailed Sep. 26, 2006 in issued parent U.S. Appl. No. 10/750,998, "*Wall Fastener*", (8 pages).

(Continued)

*Primary Examiner*—Richard E Chilcot, Jr.
*Assistant Examiner*—Jessica Laux
(74) *Attorney, Agent, or Firm*—Pauly, DeVries Smith & Deffner, L.L.C.

(57) ABSTRACT

A wall fastener that attaches a wallboard member to a mounting track in a manner that allows for relative movement between an overhead roof structure to which the mounting track is secured and a non-load bearing wall. The wall fastener holds the wallboard in a fixed position relative to the wall and the overhead structure to maintain a fire barrier.

8 Claims, 7 Drawing Sheets

OTHER PUBLICATIONS

Final Office Action mailed Mar. 28, 2007 in issued parent U.S. Appl. No. 10/750,998, "*Wall Fastener*" , (9 pages).

"Deflection Track Detail", *Memorandum from the Office of Statewide Health Planning and Development* Apr. 20, 1993.

"Drywall/Stell Framed Systems", *Catalog of United States Gypsum Company, Systems Floder SA-923-1993, Edition 09250/USG-3* 1993 , pp. 9,23,25 & 30.

"Perimeter Relief Runner System Details for Use in Nonbearing Walls", *UL Report* Jun. 23, 1966 , pp. 1-C4 (37 pages total).

"Perimeter Relief System for Use in Nonbearing Partition Systems", *Engineering Study by Factory Mutual Research Corporation* Jun. 18, 1969 , pp. 1-20.

"SLP-TRK Slotted Track", *Brochure from Metal-Lite, Inc.*

"Steel Framing Components and Accessories for Drywall, Plaster and Load-Bearing Construction", *Catalog of Unimast Incorporated* 1992 , p. 14.

"Steel Framing Systems Technical Information", *Technical Book of Unimast Incorporated* 1991 , pp. 4, 28 & 29.

Harris, Robert , "New Solution for an Old Problem", *Walls & Ceilings* Aug. 1994 , 40-41.

* cited by examiner

WALL FASTENER

RELATED APPLICATIONS

The present application is a divisional of U.S. Utility patent application Ser. No. 10/750,998, now U.S. Pat. No. 7,284,355, entitled WALL FASTENER filed on Dec. 30, 2003.

BACKGROUND OF THE INVENTION

1. Field of the Invention

The present invention is directed generally to the field of building construction and, more particularly, to connections between a non-load bearing stud wall and a mounting track that is secured to an overhead structure.

2. Related Art

A typical wall to overhead structure connection is an inverted U-shaped longitudinal mounting track or slip track that receives studs between the legs of the U-shaped track. A wall cladding member is attached to at least one side of the studs. One of the legs of the mounting track is received between the studs and the wall cladding material. A top surface of the studs and wall cladding member are spaced from the overhead structure in order to allow for settling or other movement of the overhead structure (sometimes referred to as the roof or floor deck) with respect to the wall.

Various structures and materials may be used to seal the space between the top surface of the studs and wall cladding member and the overhead structure for purposes of providing an appropriate fire rating. Known sealing structures and materials have several drawbacks. For example, the use of a sealant and filling material is typically useful for very small gaps in applications where small amounts of movement between the overhead structure and the wall are possible. A sealant and filling material is susceptible to deterioration and fatigue over repeated cycles of movement, which may result in loss of the necessary fire rating., Known sealing structures, such as the slip track assembly disclosed in U.S. Pat. Nos. 5,471,805 and 5,755,066, are complex systems that require large amounts of material at a relatively high cost. Thus, a simple, cost effecting sealing structure that provides an appropriate fire rating and provides a positive attachment between the studs and the mounting or slip track would be an important advance in the art.

SUMMARY OF THE INVENTION

The present invention is directed to a wall fastener for use between a stud and a mounting or slip track. The wall fastener supports first and second wall cladding members and orients the wall cladding members relative to each other to provide a continuous wall cladding structure between the stud wall and the overhead structure to which the mounting track is secured. The wall fastener includes a first portion having first and second opposed primary surfaces and first and second sides. The first portion is secured to the mounting track with the first primary surface facing the mounting track and the second primary surface facing the first wall cladding member. The wall fastener also includes a second portion having a third primary surface that extends parallel to the first primary surface and is offset from the second primary surface a predetermined distance. The second portion is secured to the second wall cladding member with the third primary surface facing the second wall cladding member thereby positioning the second wall cladding member adjacent to the first wall cladding member. The wall fastener further includes a first fastening structure secured to the first side of the first portion.

The first fastening structure slidingly engages the stud thereby retaining the wall fastener to the stud while providing for a sliding movement of the wall fastener relative to the stud.

Another aspect of the present invention is directed to a method of retaining a stud to a mounting track with a fastener such that the mounting track is vertically movable relative to the stud wall. The fastener includes a first portion having a first primary surface and first and second sides, and a fastening structure extending from the first side of the first portion. The method includes securing the first portion to the mounting track with the first primary surface facing the mounting track, and slidingly securing the fastening structure to the stud wall thereby retaining the stud wall to the mounting track so as to prevent lateral movement of the fastener relative to the stud wall while permitting vertical movement of the fastener relative to the stud wall.

A yet further aspect of the present invention is directed to a method of forming a wall fastener from a single piece of material. The wall fastener retains a stud wall to a mounting track and to support a secondary wall cladding member in engagement with a primary wall cladding member of the stud wall. The method includes forming a first portion that includes first and second opposed primary surfaces and first and second sides. The first portion is secured to the mounting track with the first primary surface facing the mounting track and the second primary surface facing the primary wall cladding member. The method further includes forming a second portion that includes a third primary surface that extends parallel to the first primary surface and is secured to the secondary wall cladding member, and positioning the secondary wall cladding member adjacent to the primary wall cladding member, forming a third portion that extends between the first and second portions, and forming a first fastener structure along the first side of the first portion. The first fastener structure is configured to engage a stud of the stud wall to retain the wall fastener to the stud wall while permitting vertical movement of the wall fastener relative to the wall.

Another aspect of the present invention relates to a wall fastener that is secured to a mounting track to support a secondary wall cladding member adjacent to a primary wall cladding member. The wall fastener includes a first portion having first and second opposed primary surfaces, the first primary surface defining a first portion plane, and the first portion being secured to the mounting track with the first primary surface facing the mounting track and the second primary surface facing the primary wall cladding member. A second portion of the wall fastener is spaced apart from the first portion a predetermined distance and includes third and fourth surfaces that extend parallel to the first surface. The second portion is secured to the secondary wall cladding member with the third primary surface facing the secondary wall cladding member and the fourth primary surface facing the first portion plane. A third portion of the wall fastener extends between the first and second portions to couple the first and second portions together, and a fourth portion of the wall fastener extends from the second portion in a direction toward the first portion plane and contacts the mounting track.

The present invention is also directed to a wall fastener configured to retain a stud wall to a mounting track, wherein the stud wall includes a plurality of studs and a primary wall cladding member secured to the plurality of studs. The wall fastener includes a first portion having first and second primary surfaces and first and second sides. The first portion is secured to the mounting track and is positioned between one of the plurality of studs and the primary wall cladding member with the first primary surface facing the mounting track and the one stud, and the second primary surface facing the primary wall cladding member. The wall fastener also includes a first fastening structure that extends from the first side of the first portion and retains the fastener to the one stud while providing sliding movement of the fastener relative to the one stud to provide vertical movement of the mounting track relative to the stud wall.

The present invention is also directed to a wall fastener configured to retain a stud wall to a mounting track, wherein the stud wall includes a plurality of studs and a primary wall cladding member secured to the plurality of studs. The wall fastener includes a first portion having first and second primary surfaces and first and second sides. The first portion is secured to the first side wall of mounting track with the first primary surface facing the outside surface of the first side wall and the second primary surface facing the first wall cladding member. The first portion also includes a first track retaining member that engages the inside surface of the first side wall.

DETAILED DESCRIPTION OF THE PREFERRED EMBODIMENT

Figure 1:
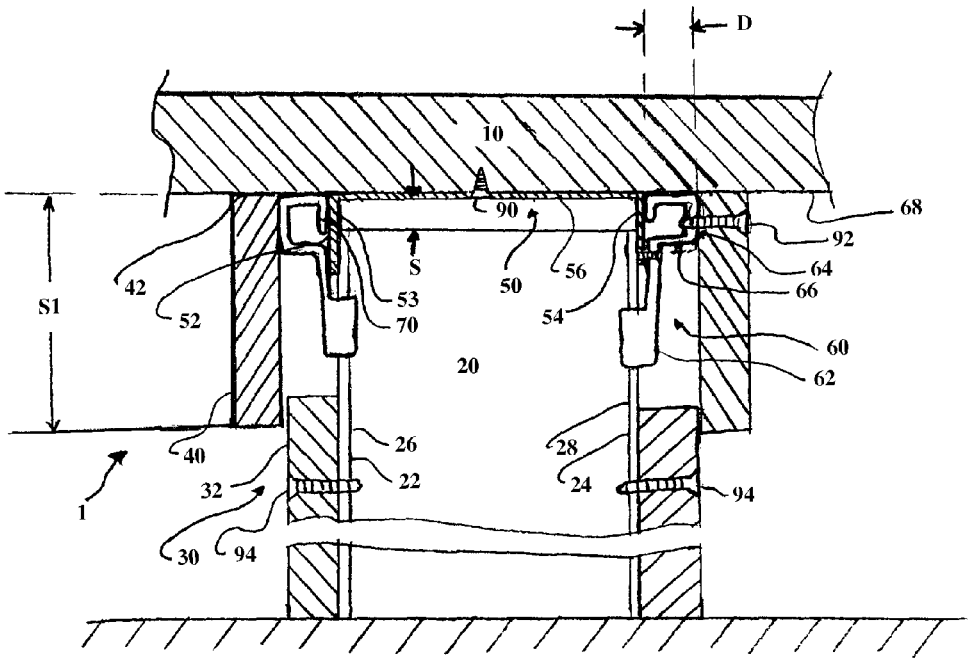
FIG. 1 is a cross-sectional view of an example slip track assembly in accordance with principle of the present invention.

Referring now to the drawings wherein similar reference numerals designate similar or corresponding parts throughout the several views, and more particularly to FIG. 1, a preferred slip track assembly in accordance with the present invention is designated generally by the numeral 1. Slip track assembly 1 includes a slip track 50 fastened to an overhead structure 10 (also referred to as a roof or floor deck), a non-load bearing stud wall 30 formed from a plurality of studs, such as the stud 20 shown, and a primary wall cladding member 32 attached to form part of the stud wall 30. The wall cladding members 32 and 40 can consist of any material that can be used to cover or overlay the studs. Some common cladding materials include, but are not limited to, gypsum board, glass, plastic, plywood, sealant, and plaster board. In the preferred embodiment, the wall cladding material is fire resistant wallboard. As used hereinafter, members 32 and 40 and similar cladding members will be referred to as "wallboard members", "wall cladding members", or "wall members". In the preferred slip track assembly 1, a wall fastener 60 is secured to a slip track 50, and a secondary wallboard member 40 is attached to the wall fastener 60. This arrangement fixes the primary wallboard member 32 to the stud 20 and the secondary wallboard member 40 to the slip track 50, and allows for relative vertical motion between the two wallboard members 32 and 40.

Figure 2:
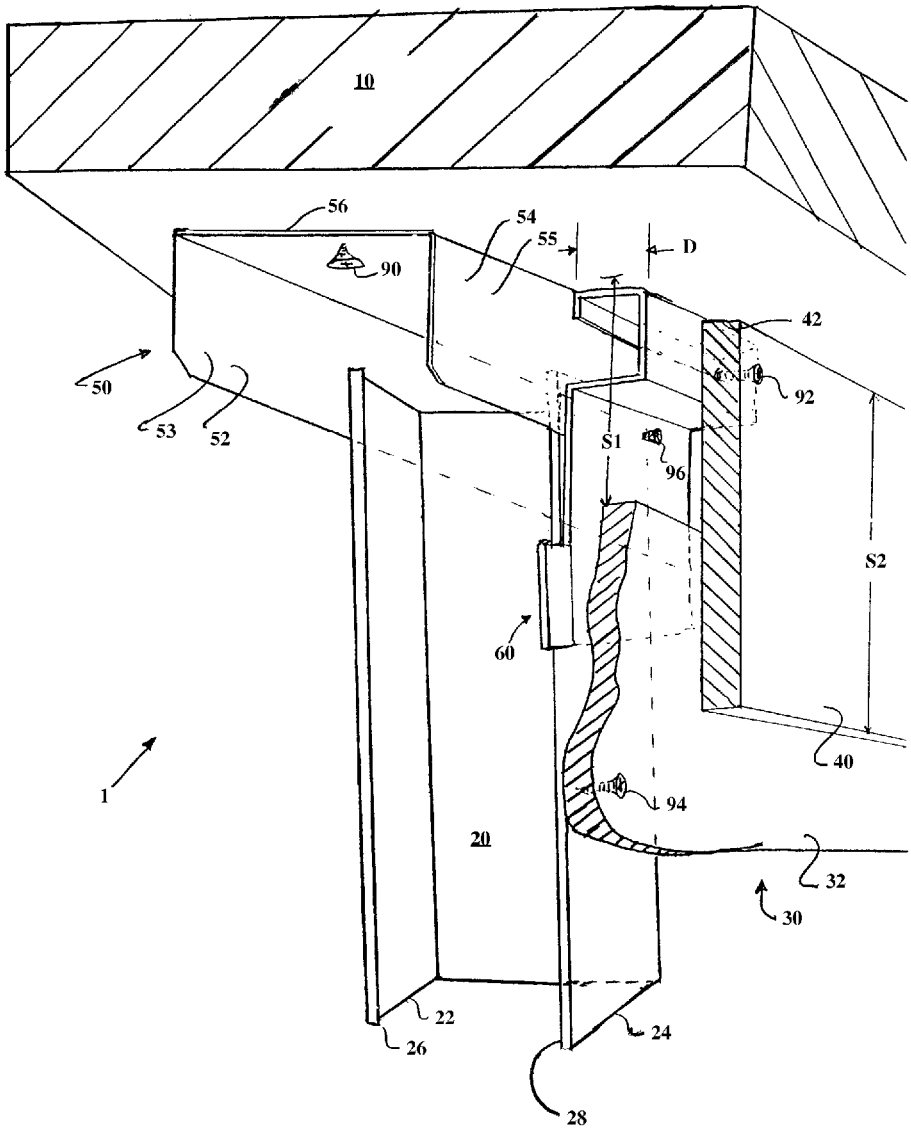
FIG. 2 is a perspective view of the slip track assembly shown in FIG. 1.
Figure 4:
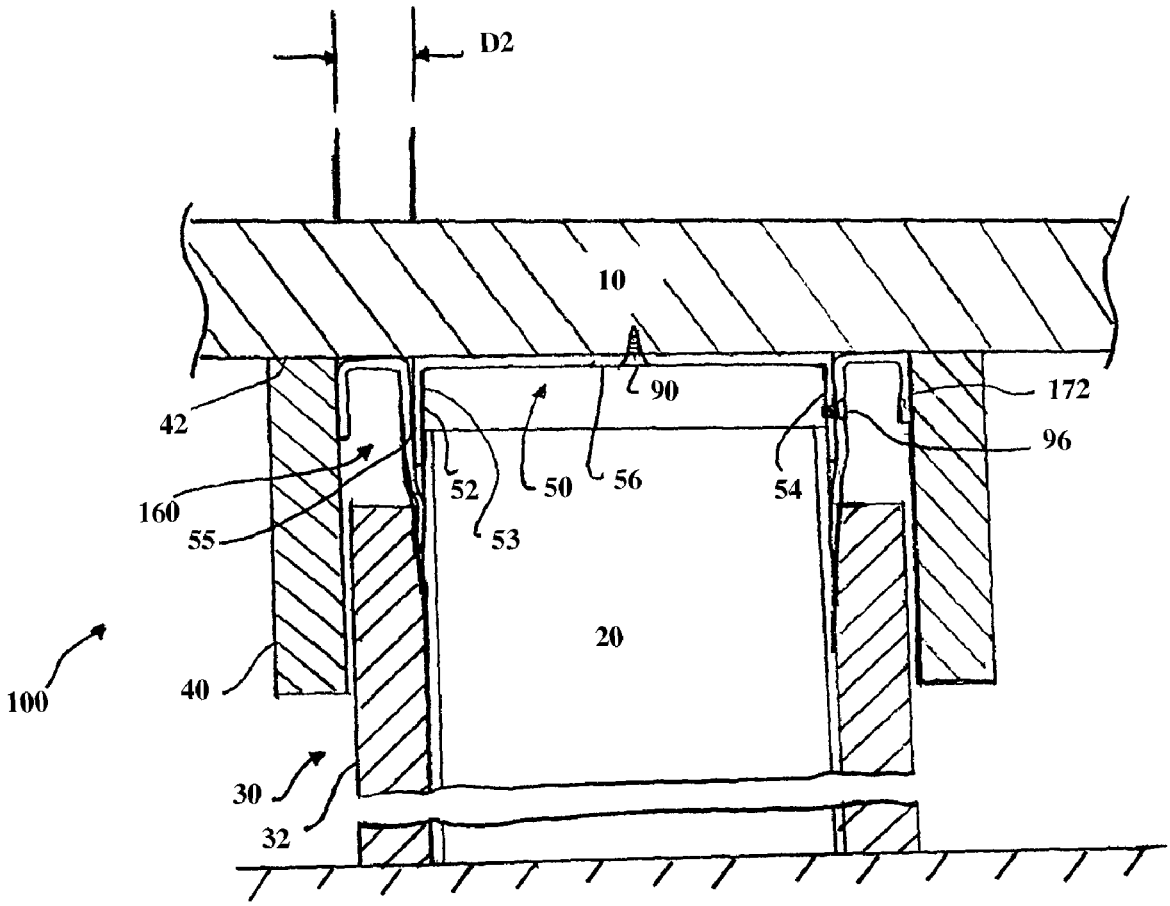
FIG. 4 is a cross-sectional view showing another example slip track assembly in accordance with principles of the present invention.
Figure 5:
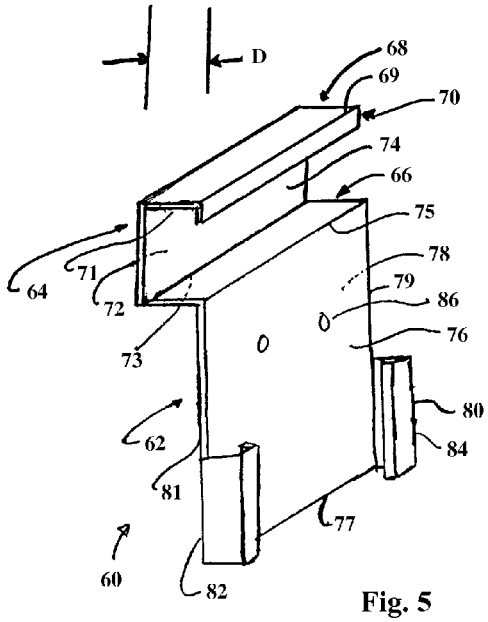
FIG. 5 is a perspective view showing an additional wall fastener embodiment of according to the principles of the present invention.

Slip track 50 is shown in FIGS. 1, 2, and 4 as a unitary member. Slip track 50 has any convenient length, and it is preferably metallic, although other materials with appropriate physical characteristics may be used. Slip track 50 has parallel first and second vertical side walls 52 and 54 offset from one another and connected by a horizontal top surface 56. The side walls 52 and 54 each have an inside surface 53 and an outside surface 55. The top surface 56 of slip track 20 is connected to the overhead structure 10 with screws 90 or other fastening means.

Figure 3:
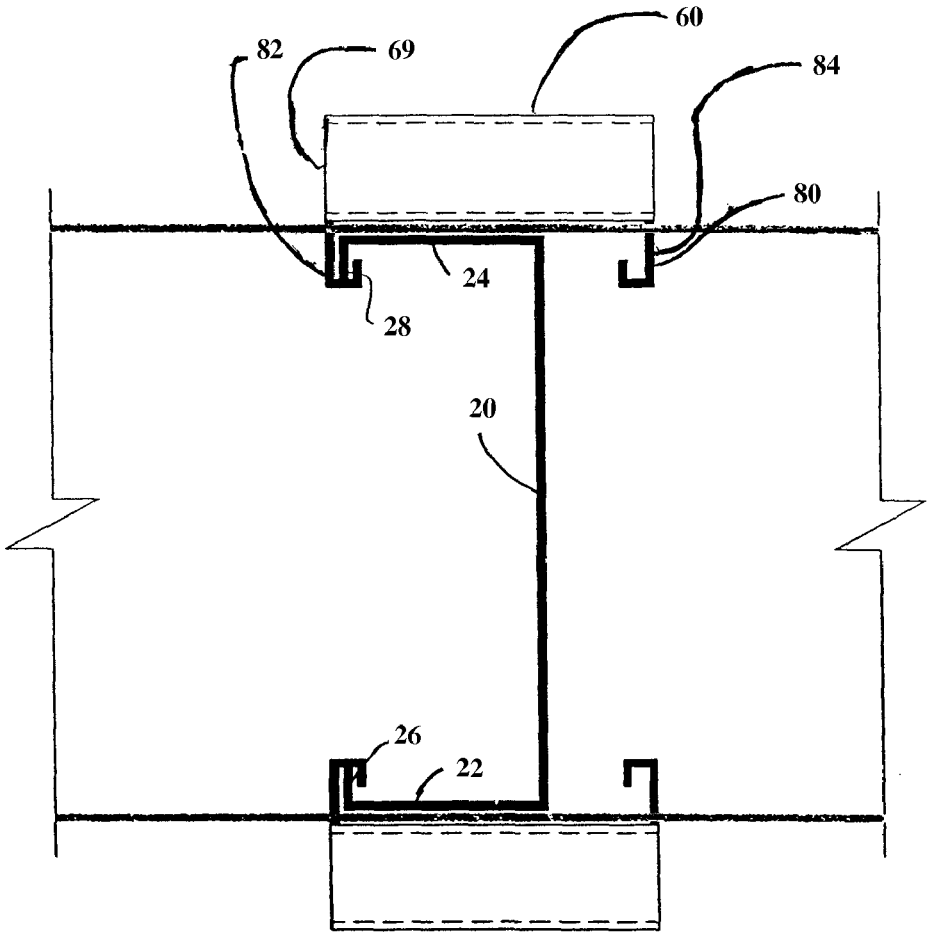
FIG. 3 is a bottom view of the slip track assembly shown in FIG. 1.

Stud 20 is shown in FIGS. 1, 2, and 3 as being received between the inside surfaces 53 of the slip track 50 such that a first side 22 and a second side 24 of stud 20 are adjacent to respective vertical side walls 52 and 54 of the slip track 50. The first and second sides 22, 24 include respective first and second return flanges 26, 28 that provide additional structural rigidity and strength to the stud 20. The top end of stud 20 is spaced a distance "S" from the top surface 56 of the slip track. Distance "S" is commonly about one inch, but may be significantly more or less depending on the expected relative movement between overhead structure 10 and stud 20. Stud 20 is commonly a metallic post, but may be wood or other material conventionally used as a stud.

The wall fastener 60, shown in FIGS. 1 and 2, is fixed to the slip track 50 and slideably engages the first return flange 28 of the second side 24 of the stud 20. The wall fastener 60 shown in FIGS. 1, 2, 3, and 5 preferably has four portions. The first portion 62 is vertical and defines a first primary surface 76, a second primary surface 78 as well as top edge 75, bottom edge 77, first side edge 79, and second side edge 81. The first portion 62 further includes one or more fastening structures 80 that slideably engage the return flange 28 of stud 20. The fastening structures 80 are shown in FIGS. 1, 2, 3 and 5 as wrap around structures 82 and 84 located on side edges of first portion 62. The first portion 62 also includes one or more apertures 86 for receiving fasteners 96 to fix first primary surface 76 against the first side 24 of the slip track 50.

The second portion 64 of the wall fastener 60 is parallel but offset from the first portion 62 by a distance "D." The second portion 64 defines third and fourth primary surfaces 72 and 74. The third portion 66 is horizontal and connects the top edge 75 of the first portion 62 to the bottom edge 73 of the second portion 64. The fourth portion 68 is horizontal and connects the top edge 71 of the second portion 64 with the top edge 69 of the contact member 70. The contact member 70 is in the same vertical plane as the first portion 60. The contact member 70 contacts the outside surface 55 of side wall 54 of the slip track 50 and provides extra support for the wall fastener 60 when the secondary wallboard member 40 is being secured to the third primary surface 72 of the wall fastener 60.

Primary wallboard member 32 is fastened to stud 20 with screws 94 or other conventional fastening means. Primary wall cladding member 32 is preferably gypsum board in large part due to its fire resistance properties. In that regard, it is understood that primary wall cladding member 32 may include multiple layers of wall material, for example, to create the required fire rating. The thickness of the primary wall cladding member 32 defines the distance "D" of the wall fastener 60. As stated above, stud 20 is spaced vertically lower than roof structure 10 a distance "S." Likewise, primary wall cladding member 32 is spaced a distance "S1" from the overhead structure 10. Distance "S1" is typically several inches, but could be more or less depending on the application.

As mentioned above, the secondary wall cladding member 40 is attached to the third primary surface 72 of the fastener 60 with screws 92 or other conventional fastening means. Secondary wall cladding member 40 extends down from a top edge 42 that is adjacent to overhead structure 10 and overlaps in a sliding relationship with primary wall cladding member 32. Secondary wall cladding member has a vertical dimension "S2" which is greater than "S1" to provide overlap and ensure maintenance of the overlap for all expected relative movement between overhead structure 10 and the stud wall 30. The secondary wall cladding member 40 covers the space between the top end of primary wall cladding members 32 and the overhead structure 10. The secondary wall cladding member is preferably made of material similar to the material of the primary wall cladding member 32 and preferably has a similar thickness as primary wall cladding member 32 so as to provide a consistent fire rating.

A second example slip track assembly 100 is shown in FIG. 4, wherein similar structure to that of FIG. 1 is identified by similar numerals. The construction of slip track assembly 100 is generally the same as the slip track assembly 1. The primary difference between assemblies 1 and 100 is that the wall fastener 60 is replaced by a wall fastener 160; all other components are similar. The wall fastener 160 of slip track assembly 100 includes a different relationship with respect to the secondary wallboard member 40 and the stud 20 as compared to the relationship between the wall fastener 60 and the stud 20. Conversely, the slip track assembly 100 is similar to slip track assembly 1 with respect to the relationship between the primary wallboard member 32 and the stud 20, the stud 20 and the slip track 50, and the slip track 50 and the overhead structure 10.

Figure 6:
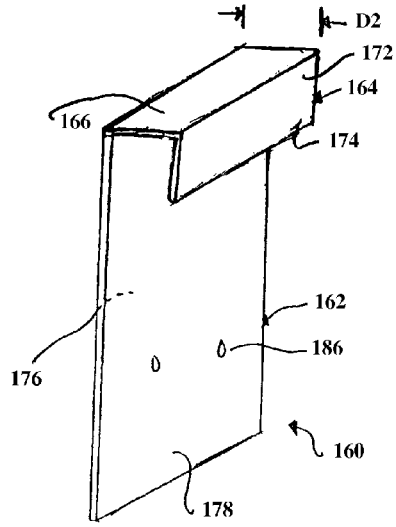
FIG. 6 is a perspective view showing an additional wall fastener embodiment according to the principles of the present invention.

The wall fastener 160 as shown in FIGS. 4 and 6 has three primary portions. The first portion 162 is vertical and defines a first primary surface 176 and a second primary surface 178, and further includes one or more apertures 186 for receiving fasteners 96 to secure the first primary surface 176 to the first side 24 of the slip track 50. The second portion 164 extends vertically at a parallel, offset position relative to the first portion a distance "D2." The second portion 164 defines a third primary surface 172 and a fourth primary surface 164. The third portion 166 extends in a generally perpendicular direction to first and second portions 162, 164 and connects the top edge of the first portion 162 to the top edge of the second portion 164.

FIG. 4 shows the secondary wallboard member 40 in the second embodiment secured to the third primary surface 172 of the second portion 164. As in slip track assembly 1, secondary wall cladding member 40 extends down from an edge 42 adjacent to overhead structure 10 and overlaps in a sliding relationship with the primary wall cladding member 32. The secondary wall cladding member 40 covers the space between the top end of primary wall cladding member 32 and the overhead structure 10.

FIG. 4 also shows the wall fastener 160 not secured to the stud 20 using, for example, the fastening structure 80 of slip track assembly 1. As such, wall fastener 160 may be especially useful for securing a secondary wallboard member 40 to a slip track 50 at a location where there is commonly no stud 20, (e.g., spaces along the wall between studs) or in comers where there is insufficient space to use a fastening structure feature.

Figure 7:
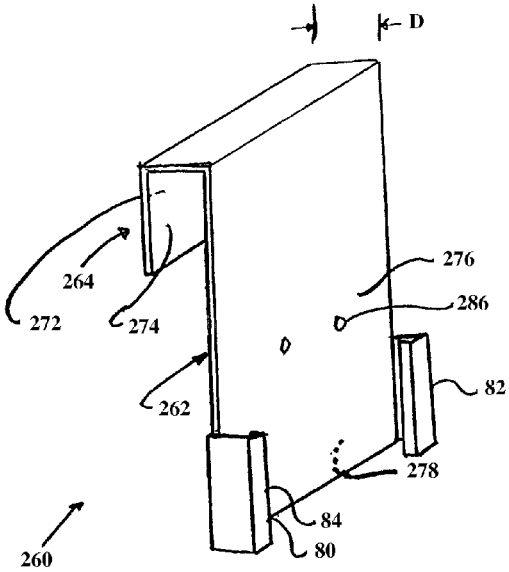
FIG. 7 is a perspective view showing an additional wall fastener embodiment according to the principles of the present invention.

FIG. 7 shows a wall fastener 260 with many of the same features as fasteners 60 and 160 including features 80, 82, and 84, which features are similar to the similarly numbered features in fastener 60. Fastener 260 includes a first portion 262, a second portion 264, a third portion 266, a first primary surface 276, a second primary surface 278, one or more apertures 286, a third primary surface 272, and a fourth primary surface 274. An advantage of this fastener embodiment is that it may provide some of the same benefits of fastener 60 (e.g., fastener 260 has the ability to prevent lateral motion of the fastener 260 relative to the stud 20), while providing a more simple design for manufacturing purposes.

Figure 8:
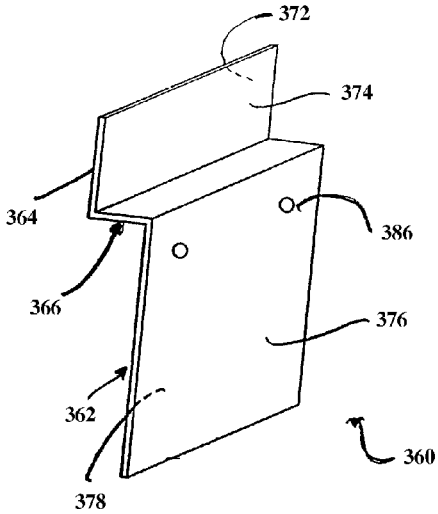
FIG. 8 is a perspective view showing an additional wall fastener embodiment according to the principles of the present invention.

FIG. 8 shows a wall fastener 360 with many of the same features as fasteners 60 and 160. Fastener 360 includes a first portion 362, a second portion 364, a third portion 366, a first primary surface 376, a second primary surface 378, one or more apertures 386, a third primary surface 372, and a fourth primary surface 374. The difference between fastener 360 and fasteners 160 and 60 is with respect to where the third portion 366 connects to the first portion 362 and second portion 364. The third portion 366 connects a top edge 375 of the first portion 362 to the bottom edge 373 of the second portion 364. Fastener 360 provides support for a secondary wall cladding member using a very simple design that may be useful in some applications.

Figure 9:
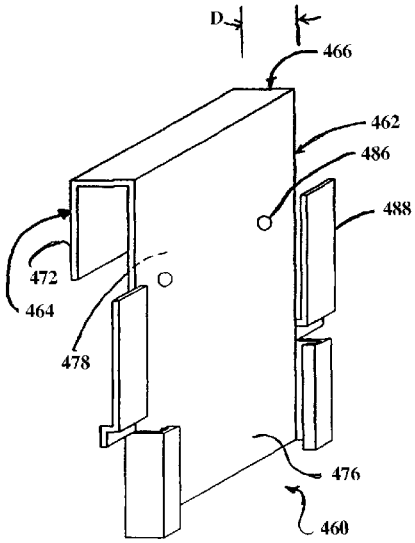
FIG. 9 is a perspective view showing an additional wall fastener embodiment according to the principles of the present invention.
Figure 9A:
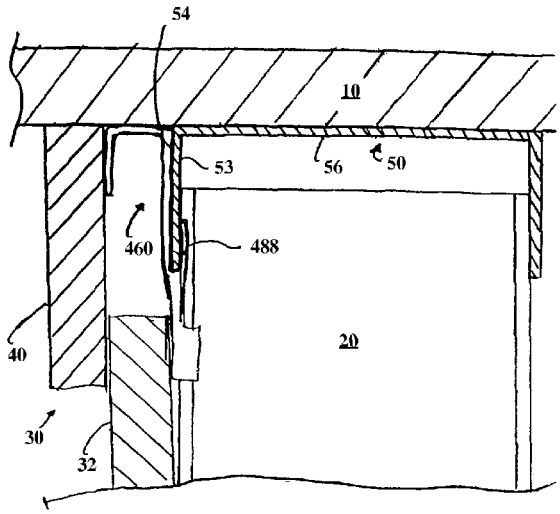
FIG. 9*a* is a cross-sectional view of an embodiment of the slip track assembly comprising the wall fastener of FIG. 9 engaged with a stud according to the principles of the present invention.

FIG. 9 shows a wall fastener 460 with many of the same features as wall fastener 260. Fastener 460 includes a first portion 462, a second portion 464, a third portion 466, a first primary surface 476, a second primary surface 478, one or more apertures 486, a third primary surface 472, and a fourth primary surface 474. In addition, fastener 460 includes first and second track retaining members 488, 489 for engaging the inside surface 53 of the first side 24 of the stud 20 and the inside surface 53 of side wall 54 of slip track 50. FIG. 9*a* shows the wall fastener 460 engaged with the stud 20 and the slip track 50. The retaining members 488, 489 may be used to hold the fastener 460 in place while the fastener 460 is secured to slip track 50 with a fastener through apertures 486.

Figure 10:
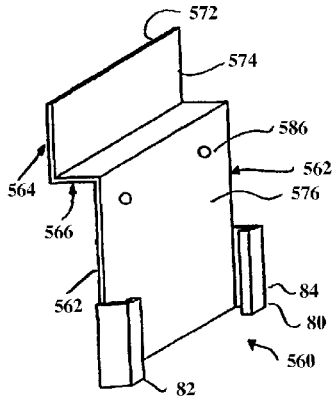
FIG. 10 is a perspective view showing an additional wall fastener embodiment according to the principles of the present invention.

FIG. 10 shows a wall fastener 560 that includes many of the same features as wall fastener 360, and also includes additional features 80, 82, and 84. These additional features are similar to the similarly numbered features in fastener 60. Fastener 560 has a first portion 562, a second portion 564, a third portion 566, a first primary surface 576, a second primary surface 578, one or more apertures 586, a third primary surface 572, and a fourth primary surface 574. The fastening structure 80 of fastener 560 provides sliding attachment of the fastener 560 to a stud (as described above with references to fastener 60) while providing a simple support structure 564, 566 for attachment of a secondary wall cladding member. Fastener 560 may also be advantageous because it can perform substantially the same function as fasteners 60, 260 and 460, while providing a more simple design for manufacturing purposes.

Figure 11:
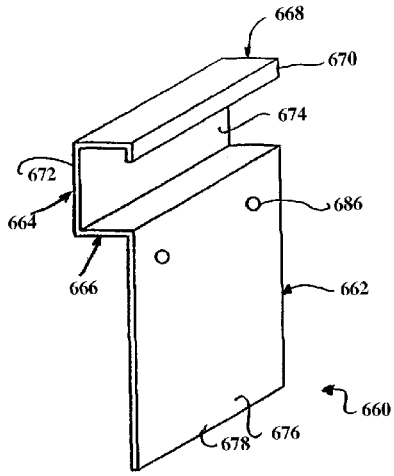
FIG. 11 is a perspective view showing an additional wall fastener embodiment according to the principles of the present invention.

FIG. 11 shows a wall fastener 660 having many of the same features as wall fastener 60. Fastener 660 includes a first portion 660, a second portion 664, a third portion 666, a fourth portion 668, a first primary surface 676, a second primary surface 678, one or more apertures 686, a third primary surface 672, a fourth primary surface 674, and a contact member 670. An advantage of fastener 660 is that it can be used in specific places on a wall as described above relating to fastener 160, yet has some of the same benefits of fastener 60. For example, fastener 660 includes a contact member 670 that provides additional support for when a secondary board member is being secured to second portion 664 of the fastener 660.

Figure 12:
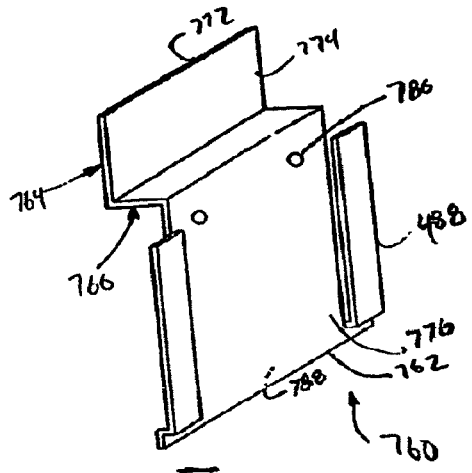
FIG. 12 is a perspective view showing an additional wall fastener embodiment according to the principles of the present invention.

FIG. 12 shows a wall fastener 760 having many of the same features as wall fastener 160. Fastener 760 includes a first portion 762, a second portion 764, a third portion 766, a first primary surface 776, a second primary surface 778, one or more apertures 786, a third primary surface 772, and a fourth primary surface 774. The difference between fastener 760 and fastener 360 is that fastener 760 has retaining members 488 for holding the fastener 760 in place on a mounting track while the fastener 760 is being secured to the mounting track with a screw or other fastening means.

Figure 13:
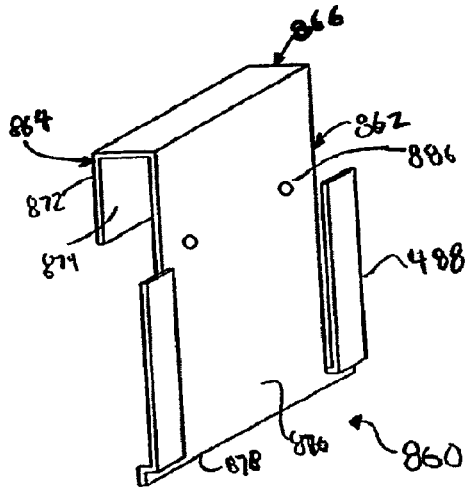
FIG. 13 is a perspective view showing an additional wall fastener embodiment according to the principles of the present invention.

FIG. 13 shows a wall fastener 860 with many of the same features of fastener 160. Fastener 860 includes a first portion 862, a second portion 864, a third portion 866, a first primary surface 876, a second primary surface 878, one or more apertures 886, a third primary surface 872, and a fourth primary surface 874. The difference between fastener 860 and fastener 160 is fastener 860 includes a pair of track retaining members 488 for holding the fastener 860 in place on a mounting track while the fastener 860 is being secured to the mounting track with a screw or other fastener means.

Figure 14:
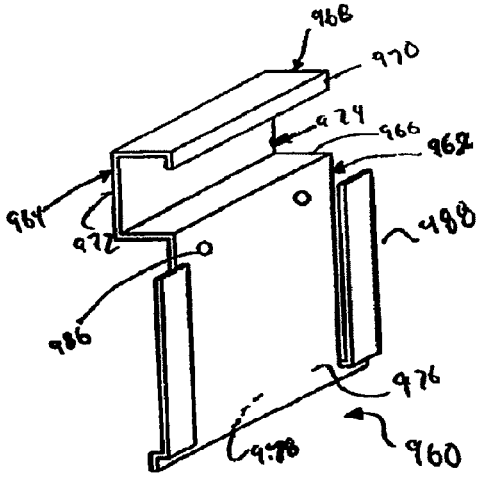
FIG. 14 is a perspective view showing an additional wall fastener embodiment according to the principles of the present invention.

FIG. 14 shows a wall fastener 960 with many of the same features of fastener 60. Fastener 960 includes a first portion 962, a second portion 964, a third portion 966, a first primary surface 976, a second primary surface 978, one or more apertures 986, a third primary surface 972, a fourth primary surface 974, and a contact member 970. The difference between fastener 960 and fastener 60 is fastener 960 includes track retaining members 488 for holding the fastener 960 in place on a mounting track while the fastener 960 is secured to the mounting track with a screw or other fastener means.

Figure 15:
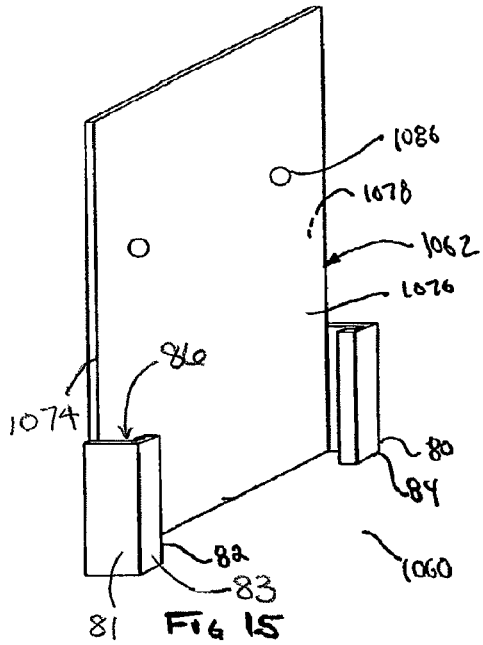
FIG. 15 is a perspective view showing an additional wall fastener embodiment according to the principles of the present invention.

FIG. 15 shows a wall fastener 1060 with some of the same features of fastener 60. Fastener 1060 includes a first portion 1062, a first primary surface 1076, a second primary surface 1078, one or more apertures 1086, and fastening structures 80, 82, and 84. The first fastening structure 82 is disposed along the first side 1075 of the first portion 1062. The first fastening structure 82 has a first segment 81 in structural communication with the first portion 1062 and a portion of the first segment 81 extends approximately perpendicular to the first primary surface 1076. A second segment 83 is in structural communication with the first segment 81, and at least a portion of the second segment 83 extends towards a central area of the first primary surface 1076. At least a portion of the first primary surface 1076, the first segment 81, and the second segment 83 cooperatively define a cavity 86 to retain the wall fastener 1060 to the stud wall while permitting vertical movement of the wall fastener 1060 relative to the stud wall.

Fastener 1060 may be used in conjunction with a sealant instead of a secondary wallboard member to achieve the proper fire rating. The fastener 1060 positively attaches the stud 20 to the slip track 50 while allowing for relative movement between the two. Fastener 1060 may be especially advantageous in situation where the displacement between the stud 20 and slip track 50 is relatively small.

The present invention, as described, achieves a fire barrier connection that provides for vertical movement between the overhead structure and the stud wall. The slip track assembly generally functions in a telescoping fashion to provide for an appropriate fire rating even when relative movement occurs. The slip tracks of the present invention can also be used horizontally or in other orientations between two surfaces that may move relative to one another to provide a fire barrier.

The wall fasteners 60, 260, 360, 460, 560, and 1060 include fasteners 80, 82, 84 on both side edges that allow the respective wall fasteners to be slideably secured to the stud 20 on either side of the stud wall 30 (for example, see the arrangement of FIG. 3). The fasteners according to the present invention make it possible to provide a single wall fastener product for a user when two may be required otherwise.

Another aspect of the present invention is directed to a method of retaining a stud wall 20 to a mounting track 50 with a fastener such that the mounting track is vertically movable relative to the stud wall. The fastener of this method could be any of fasteners 60, 160, 260, 360, 460, 560, 660, 760, 860, 960, or 1060. The method includes securing a first portion of the fastener to the mounting track with a first primary surface facing the mounting track, and securing the fastening structure to the stud wall with a sliding attachment thereby retaining the stud wall to the mounting track so as to prevent lateral movement of the fastener relative to the stud wall while permitting vertical movement of the fastener relative to the stud wall.

A yet further aspect of the present invention is directed to a method of forming a wall fastener from a single piece of material. The fastener of this method could be any of fasteners 60, 160, 260, 360, 460, 560, 660, 760, 860, 960, or 1060. The method includes forming a first portion that includes a first opposed primary surface and a second opposed primary surface, and first side edge and second side edge. The first portion is secured to the mounting track with the first primary surface facing the mounting track and the second primary surface facing the first wallboard member. The method further includes forming a second portion that includes a third primary surface that extends parallel to the first primary surface and is secured to a second wallboard member, and positioning the second wallboard member adjacent to the first wallboard member, forming a third portion that extends between the first and second portions, and forming a first fastener structure along the first side edge of the first portion. The first fastener structure is configured to engage a stud to retain the wall fastener to the stud while permitting vertical movement of the wall fastener relative to the stud wall.

Numerous characteristics and advantages of the invention have been set forth, together with details of structure and function. It is to be understood, however, that the disclosure is illustrative only. Therefore, any changes made, especially in matters of shape, size, and arrangement, to the fullest extent by the general meaning of the terms in which the appended claims are expressed, are within the principle of the invention.

We claim:

1. A wall fastener for use between a stud wall and a slip track, configured to support a continuous wallboard member between the stud wall and the slip track, the wall fastener comprising:

a first portion having first and second opposed primary surfaces and first and second sides, the first portion configured to be secured to an outside surface of a sidewall of a slip track with the first primary surface facing the outside surface and the second primary surface configured to be facing a wallboard member;

the first portion having a first fastening structure along the first side of the first portion wherein the first fastening structure comprises:

a first segment in structural communication with the first portion, wherein a portion of the first segment extends approximately perpendicular to the first surface; and a second segment in structural communication with the first segment, wherein a portion of the second segment extends towards a central area of the first primary surface;

whereby at least a portion of each of the first primary surface, the first segment, and the second segment cooperatively define a cavity configured to engage a stud of a stud wall to retain the wall fastener to the stud wall while permitting vertical movement of the wall fastener relative to the stud wall;

the first portion defining an aperture formed therein, the aperture being sized to receive a fastener for securing the first portion to the slip track.

2. The wall fastener of claim 1, wherein the first portion comprises a second fastening structure along the second side of the first portion, the second fastening structure configured to engage a stud of the stud wall to retain the wall fastener to the stud wall while permitting vertical movement of the wall fastener relative to the stud wall.

3. The wall fastener of claim 2, wherein the first portion is movably positioned between the wallboard member and the stud.

4. The wall fastener of claim 1, wherein the wall fastener comprises a single unitary piece of material.

5. A wall fastener for use between a stud wall and a slip track, configured to support a continuous wallboard member between the stud wall and the slip track, the wall fastener comprising:

a first portion having first and second opposed primary surfaces and first and second sides, the first portion securing an outside surface of a sidewall of a slip track with the first primary surface facing the outside surface and the second primary surface facing a wallboard member;

the first portion having a first fastening structure along the first side of the first portion engaging a return flange of a stud of a stud wall to retain the wall fastener to the stud wall while permitting vertical movement of the wall fastener relative to the stud wall;

the first portion defining an aperture formed therein, the aperture being sized to receive a fastener for securing the first portion to the slip track.

6. The wall fastener of claim 5, wherein the first portion comprises a second fastening structure along the second side of the first portion, the second fastening structure engaging a stud of the stud wall to retain the wall fastener to the stud wall while permitting vertical movement of the wall fastener relative to the stud wall.

7. The wall fastener of claim 6, wherein the first portion is movably positioned between the wallboard member and the stud.

8. The wall fastener of claim 5, wherein the wall fastener comprises a single unitary piece of material.

* * * * *